US007547154B2

(12) United States Patent
Kawaguchi

(10) Patent No.: US 7,547,154 B2
(45) Date of Patent: Jun. 16, 2009

(54) SHEET MATERIAL CUTTING UNIT AND PRINTING DEVICE

(75) Inventor: Kouji Kawaguchi, Chiba (JP)

(73) Assignee: Seiko Instruments Inc. (JP)

( * ) Notice: Subject to any disclaimer, the term of this patent is extended or adjusted under 35 U.S.C. 154(b) by 284 days.

(21) Appl. No.: 11/488,252

(22) Filed: Jul. 18, 2006

(65) Prior Publication Data

US 2007/0028739 A1 Feb. 8, 2007

(30) Foreign Application Priority Data

Aug. 4, 2005 (JP) ..... 2005-227070

(51) Int. Cl.
*B41J 11/70* (2006.01)
*G07B 5/02* (2006.01)
*B65H 35/06* (2006.01)

(52) U.S. Cl. ..... 400/621; 400/691; 83/651

(58) Field of Classification Search ..... 101/93.07; 83/24, 98–100; *G07B 5/02; B65H 35/06*
See application file for complete search history.

(56) References Cited

U.S. PATENT DOCUMENTS 4,356,054 A 10/1982 Götz ..... 156/517
5,001,956 A 3/1991 Nitsch ..... 83/620

FOREIGN PATENT DOCUMENTS

| | | |
|---|---|---|
| EP | 0634275 | 1/1995 |
| EP | 1506875 | 2/2005 |
| FR | 1478845 | 4/1967 |
| FR | 2548805 | 1/1985 |
| WO | 9206830 | 4/1992 |

*Primary Examiner*—Daniel J Colilla
*Assistant Examiner*—Marissa L Ferguson-Samreth
(74) *Attorney, Agent, or Firm*—Adams & Wilks

(57) ABSTRACT

A sheet material cutting unit has a movable blade mounted to undergo reciprocal movement relative to a stationary blade for cutting a sheet material, and a movable blade holder that reciprocates with the movable blade. A sheet material retaining structure retains the sheet material on a sheet material transfer path during cutting of the sheet material and comprises oppositely disposed stationary and movable holding portions, with the movable holding portion being mounted on the movable blade holder for reciprocal movement therewith. A transmitting structure transmits reciprocation of the movable blade to the movable holding portion to maintain the sheet material in a sandwiched state between the movable holding portion and the stationary holding portion during cutting of the sheet material. The transmitting structure has a notch portion formed in the movable blade holder, a biasing member disposed in the notch portion, and a protrusion of the movable holding portion extending into the notch portion and contacting the biasing member so that during movement of the movable blade toward the stationary cutting member, the movement of the movable blade is transmitted to the movable holding portion.

14 Claims, 7 Drawing Sheets

SHEET MATERIAL CUTTING UNIT AND PRINTING DEVICE

BACKGROUND OF THE INVENTION

1. Field of the Invention

The present invention relates to a sheet material cutting unit for cutting a long length of a printed sheet material at a desired position and to a printing device provided with the sheet material cutting unit.

2. Related Background Art

Conventionally, as a sheet material cutting device, one for cutting a sheet material placed between a fixed blade and a movable blade by reciprocating the movable blade with respect to the fixed blade and sliding the two blades with respect to each other, "a cut-through type" sheet material cutting device, is widely known.

Since such a sheet material cutting device can cut a sheet material with a simple drive, it is suitable to be mounted on a small printer device provided for a cash register or an ATM which issues a receipt. A sheet material cutting device described in Patent Document 1 is one such the sheet material cutting unit.

Here, operation of a conventional sheet material cutting unit of a cut-through type is described with reference to FIG. 6, FIG. 7 A, FIG. 7 B, FIG. 7 C, FIG. 7 D, FIG. 7 E, FIG. 7 F, and FIG. 8. FIG. 6 is a sectional view illustrating a thermal printer 101 provided with a conventional sheet cutting unit. FIG. 7A to FIG. 7F are a view illustrating operation of the conventional sheet material cutting unit. FIG. 8 is an enlarged view of a main part during conventional cutting of a sheet material.

As illustrated in FIG. 6, a conventional thermal printer is provided with a sheet material cutting unit 105 above a printing portion 104 having a thermal head 102 for printing and a platen roller 103. A sheet material S to be printed such as a roll of thermal paper is transferred from a lower part of the printer, and when it passes between the thermal head 102 for printing and the platen roller 103, printing is carried out. The printed sheet material S is sent to the sheet material cutting unit 105 to be cut to a desired length.

The sheet material cutting unit 105 is provided with a fixed blade unit 106 and a movable blade unit 107 placed to be opposed to the fixed blade unit 106. The fixed blade unit 106 is formed of a fixed blade holder 109, a fixed blade 108 fixed by the fixed blade holder 109, a supporting portion 110 provided in the fixed blade holder 109 for rotatably supporting an end opposite to a cutting edge of the fixed blade 108, and a spring member 111 provided between the fixed blade 108 and the fixed blade holder 109 for biasing upward the cutting edge of the fixed blade 108.

On the other hand, the movable blade unit 107 is formed of a movable blade 112, a movable blade holder 113, and a slide mechanism capable of horizontally sliding the movable blade 112 with respect to the fixed blade 108. The movable blade holder 113 is a plate-like member made of a plastic member or the like, and functions as a guide for protecting the movable blade 112 against direct contact with a housing and for sliding the movable blade 112 straight. Further, the movable blade 112 has an outer appearance where its cutting edge is substantially V-shaped or formed in a slanting direction, and is reciprocated horizontally with respect to the fixed blade 108 by the slide mechanism.

During standby before cutting, an upper surface of the fixed blade 108 is positioned above a lower surface of the movable blade 112 with the biasing force of the spring member 111. Therefore, when the movable blade 112 is moved toward the fixed blade 108 by the slide mechanism and an attracting portion 114 formed at the tip of the movable blade 112 runs onto and intersects the fixed blade 108, the fixed blade 108 is pressed down to a horizontal position of the movable blade 112 against the biasing force of the spring member 111. Thus, contact pressure which is equal to the reaction force of the spring member 111 acts between the cutting edges of the movable blade 112 and the fixed blade 108. By moving the movable blade 112 on the upper surface of the fixed blade 108 with this state maintained, the movable blade 112 and the fixed blade 108 slide on each other with the contact pressure and the sheet material S which is interposed between the blades is cut.

Here, as illustrated by vertical arrows in FIG. 8, when the sheet material is cut, the sheet material S applies side pressure to the movable blade 112 and the fixed blade 108 such that the space between the blades is widened. Therefore, in order to cut the sheet material S, it is necessary that the contact pressure between the movable blade 112 and the fixed blade 108 is higher than this side pressure. However, if the contact pressure is too high, frictional load applied to the fixed blade 108 and the movable blade 112 is increased, and thus, a problem is caused that the capacity of a motor for driving the movable blade 112 has to be increased further than necessary.

Further, the larger the slant angle of the sheet material S is, the higher the side pressure becomes. Therefore, when the blades are worn out and blunted such that the sheet material S tends to fall in the sliding direction of the movable blade 112, the side pressure applied from the sheet material S is increased. When the side pressure becomes higher than the contact pressure, the posture in the cutting is not stable, poor cutting is caused, and, as illustrated in FIG. 7C, the sheet material S is caught between the fixed blade 108 and the movable blade 112. After that, the movable blade 112 returns to its initial position as illustrated in FIGS. 7D to 7F, but the sheet material remains uncut.

In order to solve such problems, conventionally, two possible ways have been proposed:

(1) suppress the wear of the blades; and (2) is to form an outlet in the housing such that the sheet material becomes more difficult to fall.

However, in the case of (1), though methods such as increasing the hardness of the material of the blades, increasing the robustness of the blades by quenching the blades themselves, and performing surface hardening process such as coating can be considered, these methods have a problem that the cost is increased.

Further, in the case of proposal (2), although the falling of the sheet material S can also be prevented by narrowing the width of the outlet in the housing of the printing device body to thereby support the sheet material S, there is also a problem that, if the width of the outlet is decreased too much, the sheet material tends to jam near the outlet when the sheet material is transferred. Therefore, in order that both the falling of the sheet material and the jam of the sheet material are reduced, the width and the angle of the sheet material outlet in the housing must be limited, to restrict thereby restricting the design flexibility of the housing.

SUMMARY OF THE INVENTION

Accordingly, an object of the present invention is to provide a sheet material cutting unit which adjusts the posture of a sheet material only when the sheet material is cut and which is capable of stable cutting.

A first aspect of the present invention which solves the above problem-resides in a sheet material cutting unit, including: a fixed blade; a movable blade for cutting a sheet material by being reciprocated with respect to the fixed blade, the fixed blade and the movable blade being placed to be opposed to each other with a sheet material transfer path therebetween; and sheet material retaining means provided downstream from a sheet material cutting position in a sheet material transfer direction, for retaining the sheet material on the sheet material transfer path during the cutting. By supporting the sheet material to prevent it from falling when the sheet material is cut, the movable blade can bite the sheet material with stability during the cutting, and the state can be maintained until the cutting ends.

A second aspect of the present invention resides in a sheet material cutting unit, in which the sheet material retaining means includes: a sheet material fixedly holding portion provided in parallel with the fixed blade; a sheet material movably holding portion provided to be opposed to the sheet material fixedly holding portion with the sheet material transfer path therebetween; and reciprocation follow means for making the sheet material movably holding portion follow the reciprocation of the movable blade for maintaining the sheet material in a sandwiched state between the sheet material movably holding portion and the sheet material fixedly holding portion during cutting, and for releasing the sheet material from the sandwiched state when the movable blade moves backward. This can make the sheet material movably holding portion follow the reciprocation of the movable blade with respect to the fixed blade, and can make the sheet material retained without fail during cutting to realize a stable cutting operation.

A third aspect of the present invention resides in a sheet material cutting unit, in which the reciprocation follow means includes an elastic member for coupling the movable blade and the sheet material movably holding portion to transmit the reciprocation of the movable blade to the sheet material movably holding portion and for, after the sheet material movably holding portion and the sheet material fixedly holding portion sandwich the sheet material, allowing only the reciprocation of the movable blade while contracting. This allows the reciprocation follow means to have a simple structure which accomplishes the coupled state by the elastic member.

A fourth aspect of the present invention resides in a sheet material cutting unit further including a second sheet material retaining means is provided upstream from the sheet material cutting position in the sheet material transfer direction for retaining the sheet material on the sheet material transfer path during the cutting. Since the sheet material is retained before and after the cutting position, the sheet material can be retained with more stability to carry out accurate cutting irrespective of the system adopted by a printing portion.

A fifth aspect of the present invention resides in a printing device provided with the sheet material cutting unit according to the first to fourth aspects, which includes a printing portion provided upstream from the sheet material cutting position in the sheet material transfer direction for printing on the sheet material. This makes it possible to provide the printing device which eliminates the need for maintenance due to a jammed sheet material or the like and which has stable sheet material cutting quality.

A sixth aspect of the present invention resides in a printing device provided with the sheet material cutting unit according to the fourth aspect, in which the second sheet material retaining means includes: a thermal head for printing on the sheet material; and a platen roller opposed to the thermal head with the sheet material transfer path therebetween. This makes it possible to provide the printing device which can retain without fail and can cut the sheet material without providing an additional member.

As described in the above, a sheet material cutting unit according to the present invention can make stable the cutting operation and can secure quality in cutting performance by making stable the sheet material posture when the sheet material is cut such that the sheet material does not fall. Further, since appropriate tension is applied to the sheet material during the cutting, the cutting quality can be improved.

Further, since the blades themselves can be made of an inexpensive material and surface treatment and the like are unnecessary, the cost can be reduced. Further, since a load on the cutting edge is reduced, sufficient durability can be secured without maintenance of the cutting edge such as grinding.

Still further, since the sheet material is supported such that the sheet material does not fall only when the sheet material is cut, it is not necessary to decrease the size of the outlet, and thus, there is no fear that the sheet material jams. Further, since the sheet material cutting unit alone can cut the sheet material without fail, the design flexibility of the exterior on the side of the printing device can be secured.

DETAILED DESCRIPTION OF THE PREFERRED EMBODIMENTS

In the following, embodiments of the present invention are described with reference to the drawings.

Figure 1:
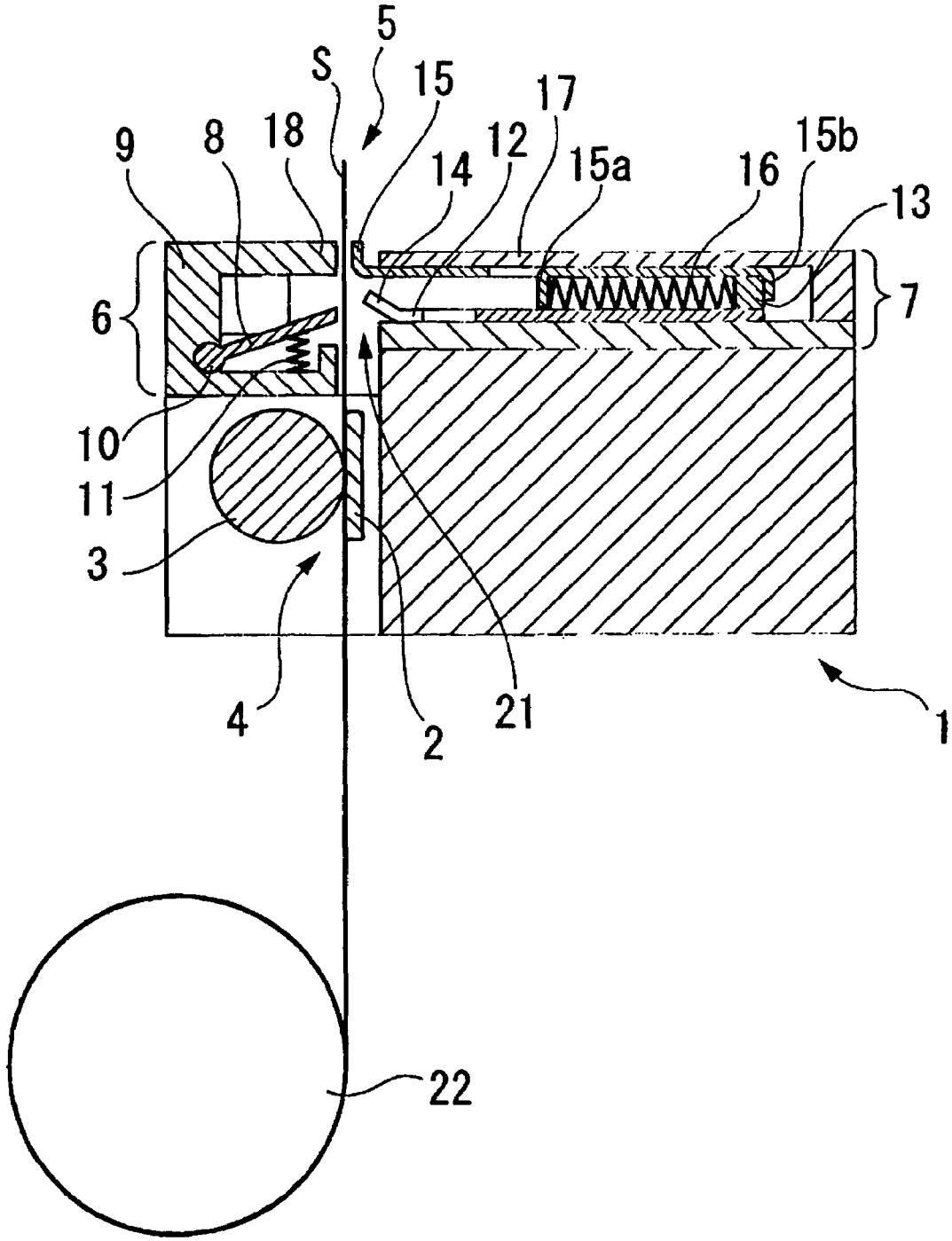
FIG. 1 is a sectional view illustrating a schematic structure of a thermal printer provided with a sheet material cutting unit according to a first embodiment.
Figure 2:
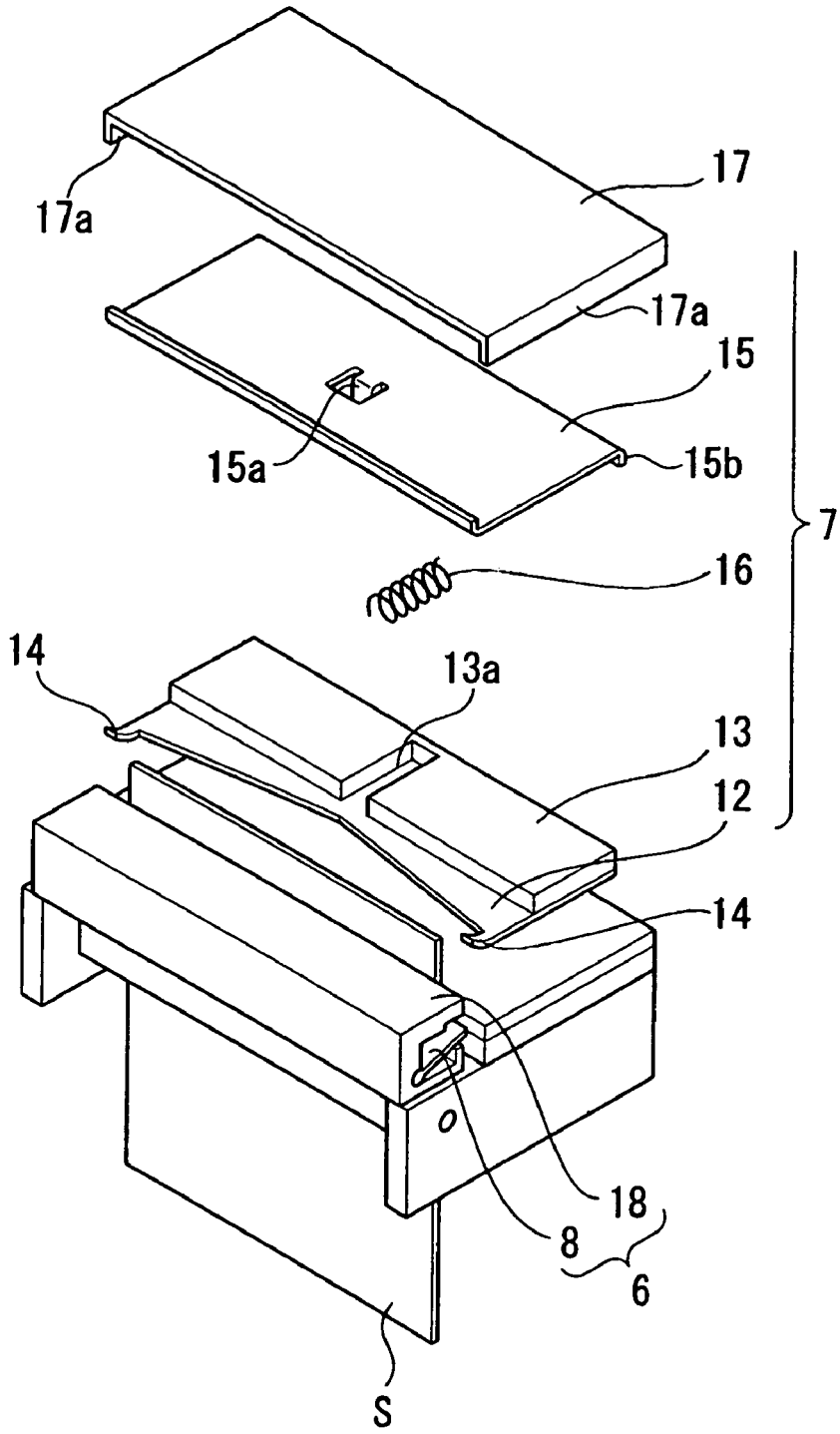
FIG. 2 is an exploded perspective view of the sheet material cutting unit according to the first embodiment.

FIG. 1 is a sectional view illustrating a schematic structure of a thermal printer provided with a sheet material cutting unit according to a first embodiment of the present invention. FIG. 2 is an exploded perspective view of the sheet material cutting unit according to the first embodiment of the present invention.

As illustrated in FIG. 1, a thermal printer 1 according to this embodiment has, as a printing portion 4, a thermal head 2 for printing serving as printing means and a platen roller 3 serving as transfer means for transferring a sheet material S. A direction of a series of movement of the sheet materials from the printing portion 4 through a sheet material cutting unit 5 to an outlet provided between a fixed blade holder 9 and a movable blade cover 17 is a sheet material transfer direction.

The material of the sheet material referred to here may be paper, plastic, any other material, or a complex thereof. With regard to the shape of the sheet material, a long length of a sheet material such as a roll of paper or continuous fanfold paper is used.

A heating portion of the thermal head 2 is formed of heating elements formed of a plurality of relatively small resistors arranged in a width direction such that dot printing is available. By selectively making the heating elements generate heat based on printing data from the external, sheet material S is printed. The platen roller 3 is formed by covering a shaft with an elastic body such as rubber, and also plays a role in bringing the sheet material S into contact with the heating portion of the thermal head 2 with appropriate pressure.

In addition to the thermal head 2 and the platen roller 3, driving members such as a motor, a gear train, and the like for driving the platen roller 3 are placed in the printing portion 4.

Further, a roll of paper 22 which is the sheet material wound into a roll is retained upstream from the printing portion 4 in the sheet material transfer direction while the sheet material cutting unit 5 for cutting the printed sheet material S to a desired length is provided downstream from the printing portion 4.

The sheet material cutting unit 5 is formed of a fixed blade unit 6 and a movable blade unit 7 which are placed to be opposed to each other. An area between the units from the printing portion 4 to the outlet is a sheet material transfer path 21.

The fixed blade unit 6 is formed of a fixed blade 8 (stationary cutting member), the fixed blade holder 9, a supporting portion 10 provided in the fixed blade holder 9 for rotatably supporting an end opposite to a cutting edge of the fixed blade 8, and a spring member 11 provided between the fixed blade 8 and the fixed blade holder 9 for biasing upward the fixed blade 8 in FIG. 1. A downstream side in the sheet material transfer path of the fixed blade holder 9, shown at an upper portion in FIG. 1, protrudes toward the sheet material transfer path to form a sheet material fixedly holding portion 18 (fixed or stationary sheet material holding portion) provided in parallel with the fixed blade 8. An end surface of the sheet material fixedly holding portion 18 which protrudes toward the sheet material transfer path is provided on an extended line of the cutting edge of the fixed blade 8 in the sheet material transfer direction. The fixed blade holder 9 and the sheet material fixedly holding portion 18, which are integrally formed in this embodiment, may be provided as separate bodies.

The movable blade unit 7 is formed of a movable-blade 12, a slide mechanism capable of horizontally reciprocating the movable blade 12 with respect to the fixed blade 8, a plate-like movable blade holder 13 fixed to an upper surface of the movable blade 12, a sheet material movably holding portion 15 provided on an opposite side of the movable blade 12 with respect to the movable blade holder 13 and on a downstream side in the sheet material transfer direction, and the movable blade cover 17 provided above the sheet material movably holding portion 15.

The movable blade 12 has an outer appearance where its cutting edge is substantially V-shaped or formed in a slanting direction. The movable blade 12 is opposed to the fixed blade 8 with the sheet material transfer path 21 therebetween, and can be horizontally slid with respect to the fixed blade 8 by the slide mechanism. As the slide mechanism, one which converts rotational force of a motor to linear movement by a gear, a linkage, and the like to reciprocate the movable blade 12 is adopted.

Further, as illustrated in FIG. 2, attracting portions 14 are formed on both ends of the cutting edge of the movable blade 12. The distance between the attracting portions 14 is larger than the width of the sheet material. During standby before cutting, an upper surface of the fixed blade 8 is positioned above a lower surface of the movable blade 12 with the biasing force of the spring member 11. Therefore, when the movable blade 12 is moved-toward the fixed blade 8 by the slide mechanism and the attracting portions 14 formed at the tips of the movable blade 12 run onto and intersect the fixed blade 8, the fixed blade 8 is pressed down by the amount of the protrusion against the biasing force of the spring member 11. Thus, contact pressure which is equal to the reaction force of the spring member 11 acts between the cutting edges of the movable blade 12 and the fixed blade 8. By moving the movable blade 12 on the upper surface of the fixed blade 8 with this state maintained, the movable blade 12 and the fixed blade 8 slide on each other with the contact pressure and the sheet material S which is interposed between the blades is cut.

The movable blade holder 13 is a plate-like member made of a plastic material or the like and includes a notch portion 13*a* in a side on the side of the sheet material transfer path 21 along the direction of the reciprocation of the movable blade 12. A spring member 16 is fit into the notch portion 13*a* so as to face the sheet material transfer path 21 as an elastic member. Further, the sheet material movably holding portion 15 is formed by bending a plate material, and a protrusion 15*a* is provided at a place which corresponds to the notch portion 13*a* of the movable blade holder 13. By aligning the sheet material movably holding portion 15 with the movable blade holder 13, the protrusion 15*a* protrudes through the notch portion 13*a* to be brought into contact with a front end surface of the spring member 16 in the notch portion 13*a*. The protrusion 15*a* prevents the spring member 16 from getting out of the notch portion 13*a*. Thus, by moving the blade 12 toward the fixed blade 8 the protrusion 15*a* is pressed through the spring member 16 to link the sheet material movably holding portion 15 with the movement.

Further, one end of the sheet material movably holding portion 15 is opposed to the sheet material fixedly holding portion 18 with the sheet material transfer path 21 therebetween, and is provided to be on an extended line of the attracting portions 14 of the movable blade 12 downstream in the sheet material transfer direction or to protrude from the extended line toward the fixed blade 8. A bend 15*b* in contact with a rear end of the movable blade holder 13 is provided at the other end of the sheet material movably holding portion 15. Thus, when the movable blade 12 moves backward, the movable blade holder 13 presses the bend 15*b* of the sheet material movably holding portion 15*a* to make the sheet material movably holding portion 15 move following the movement of the movable blade 12.

The sheet material movably holding portion 15 according to this embodiment is a thin plate-like member provided in parallel with the movable blade 12, and has a portion opposed to the sheet material fixedly holding portion 18. The portion is bent perpendicularly to form one of its ends. However, the present invention is not limited thereto, and the sheet material movably holding portion 15 may be a plate-like member without a bent similar to the sheet material fixedly holding portion 18.

The movable blade cover 17 has, on both of its sides, side wall portions 17*a* along the direction of the reciprocation of the movable blade 12. The movable blade 12, the sheet material movably holding portion 15, and the movable blade holder 13 are housed in a space between the side wall portions 17*a*, with the side wall portions 17*a* serving as guides when the movable blade 12 and the like are reciprocated.

In this way, according to this embodiment, sheet material retaining means is formed by providing the above-described sheet material fixedly holding portion 18 and sheet material movably holding portion 15 downstream from the sheet material cutting position in the sheet material transfer direction. Further, the movable blade holder 13, the spring member 16, and the protrusion 15*a* and the bend 15*b* of the sheet material movably holding portion 15 form reciprocation follow means (transmitting means) for transmitting the reciprocation of the blade 12 to the sheet material movably holding portion 15.

Examples of the material of the movable blade 12 and the fixed blade 8 used in the present invention, which is not specifically limited, desirably include steels or rust-proof stainless steel-based materials.

An outlet between the fixed blade holder 9 and the movable blade cover 17 according to this embodiment is wide enough to prevent the sheet material S from jamming.

Next, operation and action of the sheet material cutting unit according to this embodiment are described with reference to FIGS. 3A-3F.

The sheet material S printed by the thermal head 2 provided in the printing portion 4 is transferred by the platen roller 3 downstream in the sheet material transfer direction. At this stage, since the sheet material fixedly holding portion 18 and the sheet material movably holding portion 15 are away from each other, the sheet material S does not jam therebetween. When a desired cutting position on the sheet material S is transferred to the position where the fixed blade 8 and the movable blade 12 are opposed to each other, the sheet material transfer by the platen roller 3 stops with the state illustrated in FIG. 3A maintained.

Next, the movable blade 12 begins to move horizontally in the direction toward the fixed blade 8 by the slide mechanism. Here, the reciprocation of the movable blade 12 is also transmitted to the sheet material movably holding portion 15, which begins to move toward the sheet material fixedly holding portion 18. In the case of this embodiment, since the distance between the end of the sheet material fixedly holding portion 18 and the end of the sheet material movably holding portion 15 is smaller than the distance between the cutting edge of the movable blade 12 and the cutting edge of the fixed blade 8, the time when the sheet material S is sandwiched between the sheet material fixedly holding portion 18 and the sheet material movably holding portion 15 is earlier than the time when the cutting of the sheet material S starts, and the state is as illustrated in FIG. 3B. Contraction of the spring member 16 makes the sheet material movably holding portion 15 pressed with appropriate pressure to retain the sheet material S in the sheet material transfer path 21. Here, the sheet material movably holding portion 15 is brought into contact with the sheet material fixedly holding portion 18 and stops, but the spring member 16 contracts, so the movable blade 12 can maintain its reciprocation.

Since the end of the sheet material fixedly holding portion 18 which protrudes toward the sheet material transfer path 21 is provided just on an extended line of the cutting edge of the fixed blade 8 in the sheet material transfer direction, the sheet material S retaining position and the sheet material cutting position are in a line, and thus, the movable blade 12 can perpendicularly bite the sheet material S.

Figure 3A:
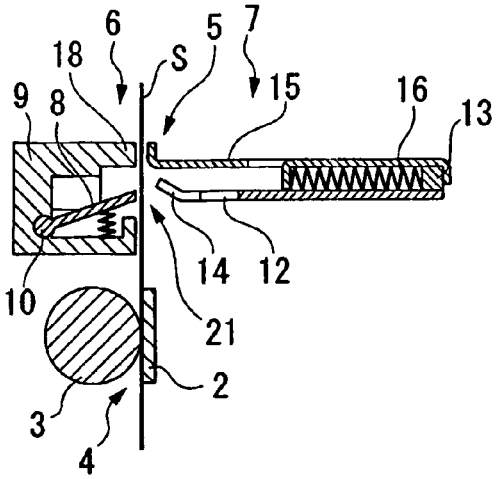
FIGS. 3A-3F are a view illustrating operation and action of the sheet material cutting unit according to the first embodiment.
Figure 3D:
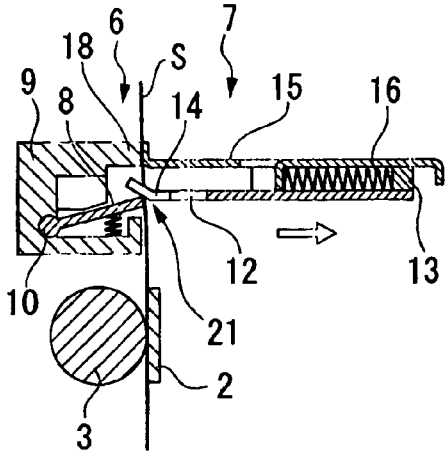
Figure 3B:
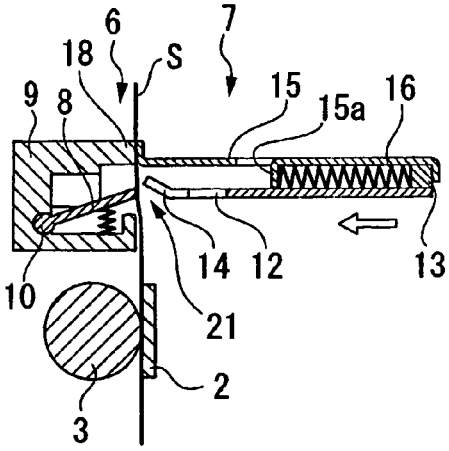
Figure 3E:
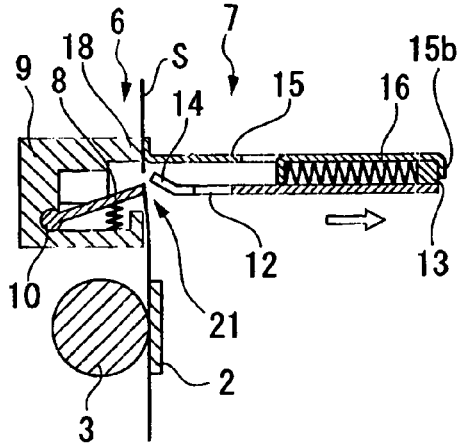
Figure 3C:
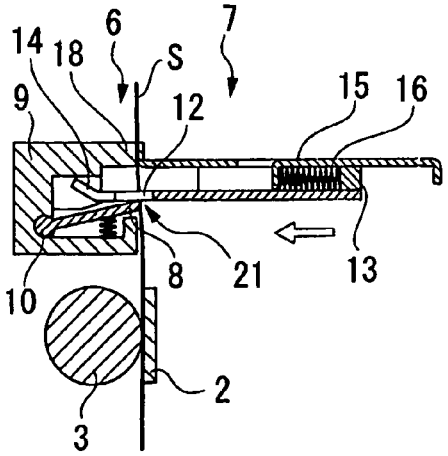
Figure 3F:
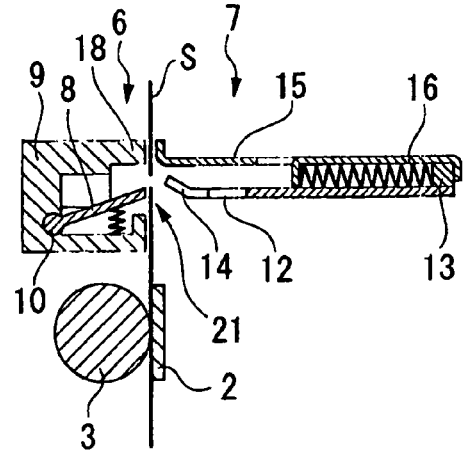

Next, the sheet material retaining means is used, and with the posture of the sheet material S retained on the sheet material transfer path, only the movable blade 12 is further moved toward the fixed blade 8 to cut the sheet material S as illustrated in FIG. 3C. Here, the state where the movable blade 12 perpendicularly bites the sheet material S can be maintained.

The sheet material S on the downstream side from the cutting position in the sheet material transfer direction is retained between the sheet material fixedly holding portion 18 and the sheet material movably holding portion 15, while its upstream side in the sheet material transfer direction is retained between the thermal head 2 and the platen roller 3. Therefore, the sheet material S is held under a certain tension to enable stable cutting.

After the cutting of the sheet material S is completed, as illustrated in FIG. 3D, the movable blade 12 starts moving backward away from the fixed blade 8. Here, although the spring member 16 begins to expand, the sheet material movably holding portion 15 does not move as yet, and the state where the sheet material S is retained between the sheet material movably holding portion 15 and the sheet material fixedly holding portion 18 is maintained.

After that, when the movable blade 12 moves backward to some extent, as illustrated in FIG. 3E, since the movable blade holder 13 pushes the bend 15*b* of the sheet material movably holding portion 15, the sheet material movably holding portion 15 follows the movable blade 12 and goes away from the sheet material fixedly holding portion 18. Then, finally, the sheet material cutting unit returns to the standby state illustrated in FIG. 3F to complete the cutting process of the sheet material. In this way, since the sheet material movably holding portion 15 returns to its initial position after the cutting of the sheet material ends, the outlet can secure a sufficient space for discharging the sheet material S.

In this embodiment, the sheet material fixedly holding portion 18 and the sheet material movably holding portion 15 are directly brought into contact with the respective sides of the sheet material S, but the sheet material cutting unit according to the present invention is not limited thereto and may have a structure in which the sheet material movably holding portion 15 stops at a position where the sheet material holding portions are opposed to each other with a certain space therebetween. In the sheet material cutting unit according to the present invention, as long as the sheet material S can be prevented from falling during the cutting, it does not matter whether the sheet material retaining means is in direct contact with the sheet material S or not. For example, when the sheet material S is a label to be affixed to a product or the like and one side thereof has adhesive applied thereto, needless sticking of the sheet material S to the printing device or needless jam of the sheet material S can be prevented by a structure in which a sheet material holding portion is not in direct contact with the sheet material S.

Further, when the sheet material does not have enough body and is easy to fall, by retaining the sheet material S with the sheet material fixedly holding portion 18 and the sheet material movably holding portion 15 which are in direct contact with the sheet material S, stable cutting can be materialized.

Further, a mechanism in which a regulating member for regulating the reciprocation of the sheet material movably holding portion 15 is provided inside the movable blade cover 17 and the position of the regulating member can be arbitrarily changed to arbitrarily change the point at which the sheet material movably holding portion 15 stops depending on the type of the sheet material used.

Further, in this embodiment, although the sheet material movably holding portion 15 is structured to be linked with the movement of the movable blade 12 via the coil spring, the present invention is not limited thereto. Other spring members such as a leaf spring may be used, and elastic members other than spring members such as sponge may be used.

Further, the present invention is not limited to the structure of this embodiment insofar as the sheet material movably holding portion 15 can move horizontally in linkage with the movement of the movable blade 12, and the sheet material movably holding portion 15 may be moved by providing another slide mechanism made of a cam member or the like linked with the movable blade 12.

Further, it is desirable that an elastic member is provided at either the end of the sheet material movably holding portion 15 or the end of the sheet material fixedly holding portion 18, or, at both ends. This may decrease noise generated when the sheet material is held, and, since such an elastic member is flexible, it is possible to hold the sheet material uniformly to accomplish a stable operation.

Figure 4:
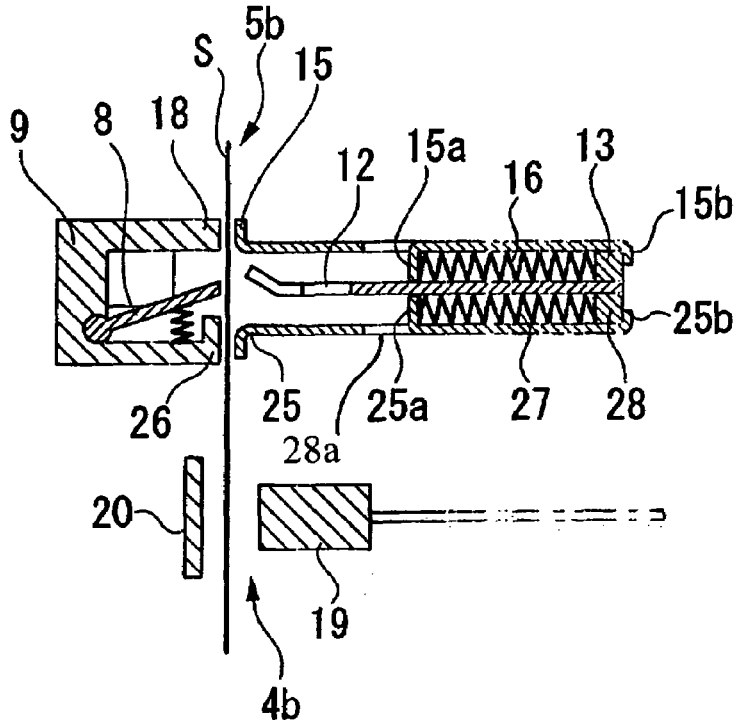
FIG. 4 is a sectional view of a sheet material cutting unit according to a second embodiment.

FIG. 4 illustrates a sheet material cutting unit according to a second embodiment of the present invention.

A sheet material cutting unit 5*b* according to this embodiment has, in addition to the sheet material retaining means provided for the first embodiment, second sheet material retaining means provided downstream from the sheet material cutting position. More specifically, a second sheet material movably holding portion 25 is provided on an opposite side of the sheet material movably holding portion 15 with the movable blade 12 therebetween.

In this embodiment, a second movable blade holder 28 is provided on a back surface of the movable blade 12 with respect to a surface thereof to which the movable blade holder 13 is provided. The second movable blade holder 28 also has a notch portion 28*a* which corresponds to the notch portion 13*a* of the movable blade holder 13. Further, the second sheet material movably holding portion 25 also has a protrusion 25*a* and a bend 25*b* similarly to the case of the sheet material movably holding portion 15. A spring member 27 is provided in the notch portion 28*a*. A front end surface of the spring member 27 is in contact with the protrusion 25*a*. By such a structure, similarly to the sheet material movably holding portion 15 according to the first embodiment, the second sheet material movably holding, portion 25 is also reciprocated following the movement of the movable blade 12.

An upstream side in the sheet material transfer path of the fixed blade holder 9, show a lower portion in FIG. 4, has a sheet material fixedly holding portion 26 formed to protrude toward the sheet material transfer path. Similarly to the first sheet material fixedly holding portion 18, an end portion of the sheet material fixedly holding portion 26 which protrudes toward the sheet material transfer path is provided on an extended line of the cutting edge of the fixed blade 8 in the sheet material transfer direction. Though the fixed blade holder 9 and the second sheet material fixedly holding portion 26 are integrally formed in this embodiment, they may be provided as separate bodies. In this way, second sheet material retaining means is formed by providing the second sheet material fixedly holding portion 26 and the second sheet material movably holding portion 25 upstream from the sheet material cutting position in the sheet material transfer direction.

When the sheet material is cut, similarly to the first embodiment, by sandwiching the sheet material S using the first sheet material retaining means and the second sheet material retaining means before the fixed blade 8 and the movable blade 12 intersect each other, the posture of the sheet material S during the cutting can be adjusted. In this way, by retaining the sheet material just upstream and downstream from the cutting position, the cutting quality can be improved.

Further, a printing portion 4*b* according to this embodiment is formed of an inkjet head 19 and a plate-like platen 20 opposed to a nozzle row of the inkjet head 19. The plate-like platen 20 according to this embodiment may be provided with a heater for drying ink ejected from the inkjet head 19. Further, in order to transfer the sheet material S, it is necessary to provide an additional transfer roller.

Further, the inkjet head according to this embodiment is, differently from the thermal head 2 according to the first embodiment, not in contact with the sheet material S.

Therefore, in this case, since the sheet material S is not retained by the thermal head 2 and the platen roller 3, by retaining the sheet material not only with the first sheet material retaining means but also with the second sheet material retaining means, appropriate tension can be applied to the sheet material S to improve the cutting quality. Of course, even when the printing portion 4*b* is a thermal head and a platen roller similarly to the first embodiment, it is possible to provide the second sheet retaining means.

Figure 5:
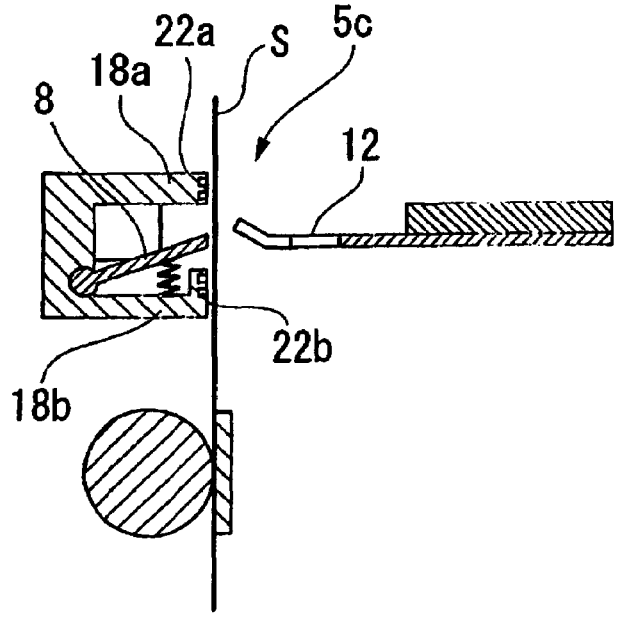
FIG. 5 is a sectional view of a sheet material cutting unit according to a third embodiment.
Figure 6:
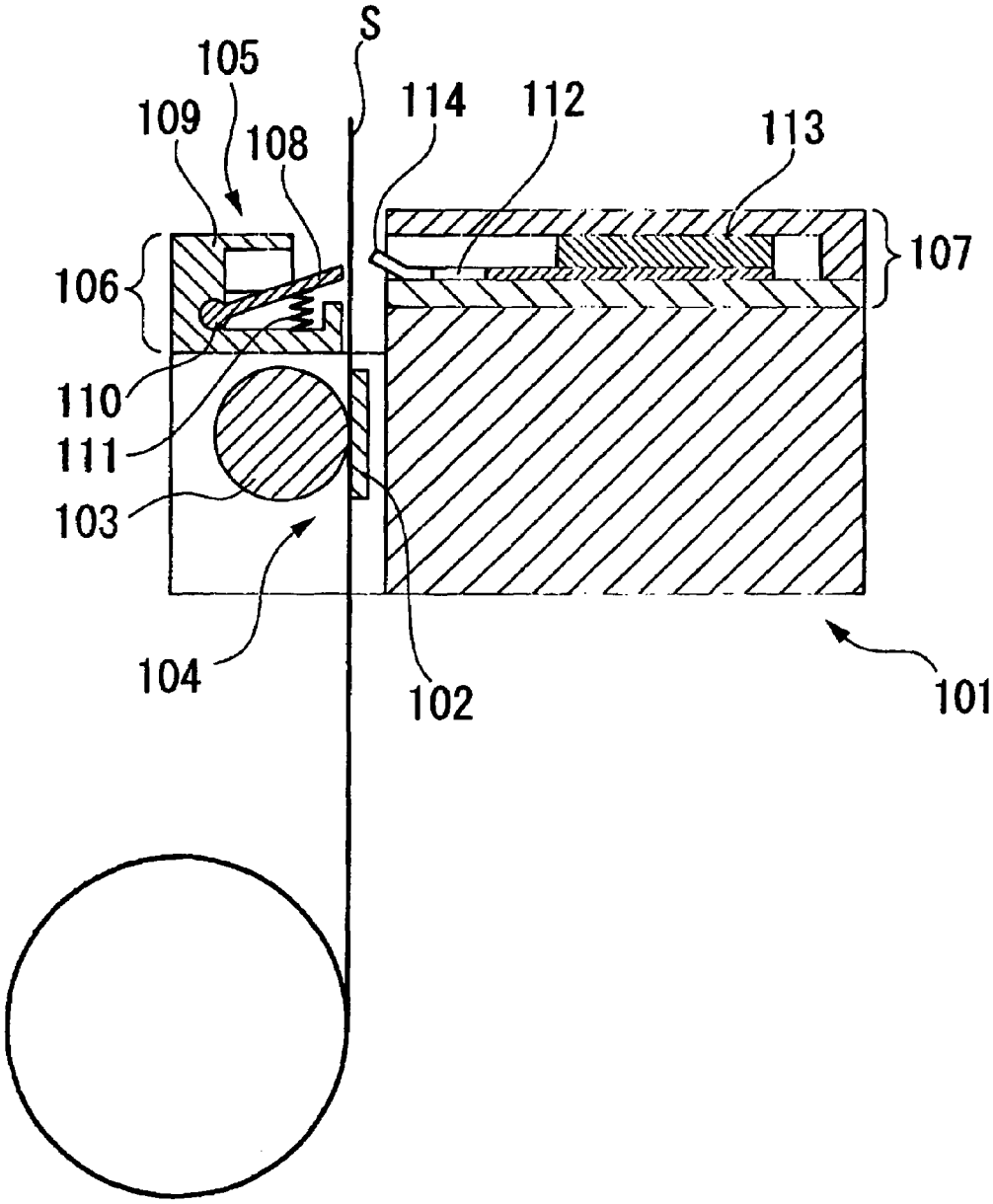
FIG.6 PRIOR ART
FIG. 6 is a sectional view illustrating a thermal printer provided with a conventional sheet cutting unit.
Figure 7A:
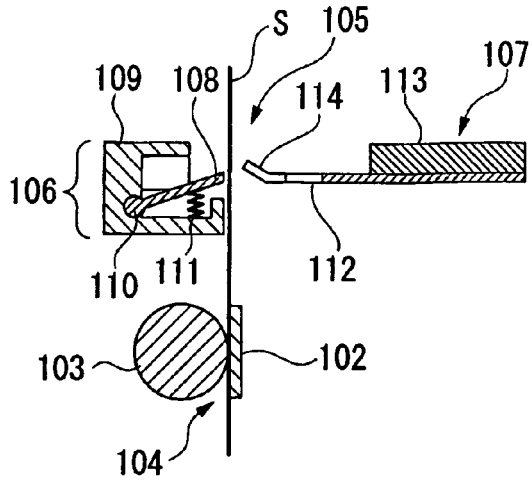
FIG. 7A PRIOR ART
FIGS. 7A-7F are a view illustrating operation of the conventional sheet material cutting unit.
Figure 7D:
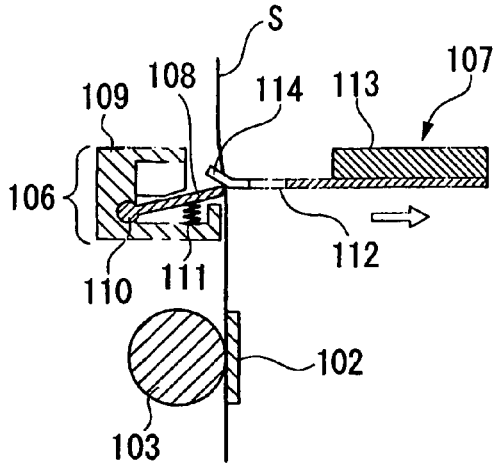
FIG. 7D PRIOR ART
Figure 7B:
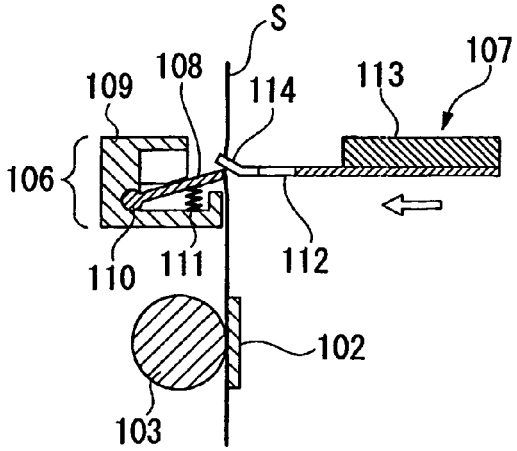
FIG. 7B PRIOR ART
Figure 7E:
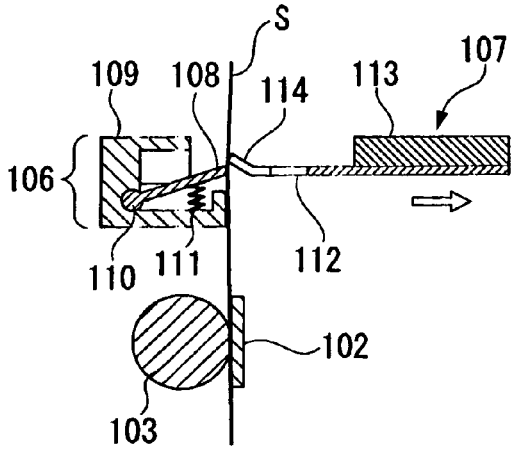
FIG. 7E PRIOR ART
Figure 7C:
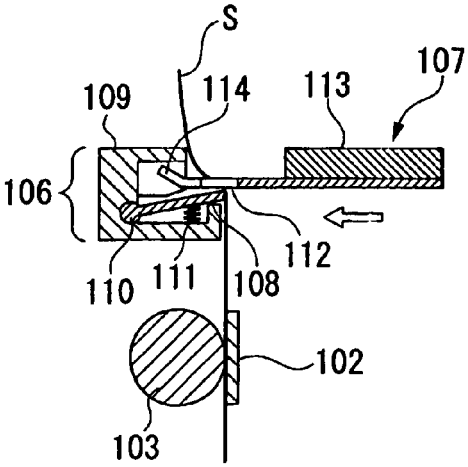
FIG. 7C PRIOR ART
Figure 7F:
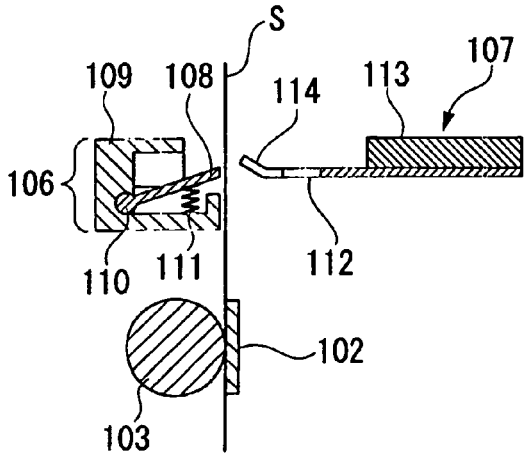
FIG. 7F PRIOR ART
Figure 8:
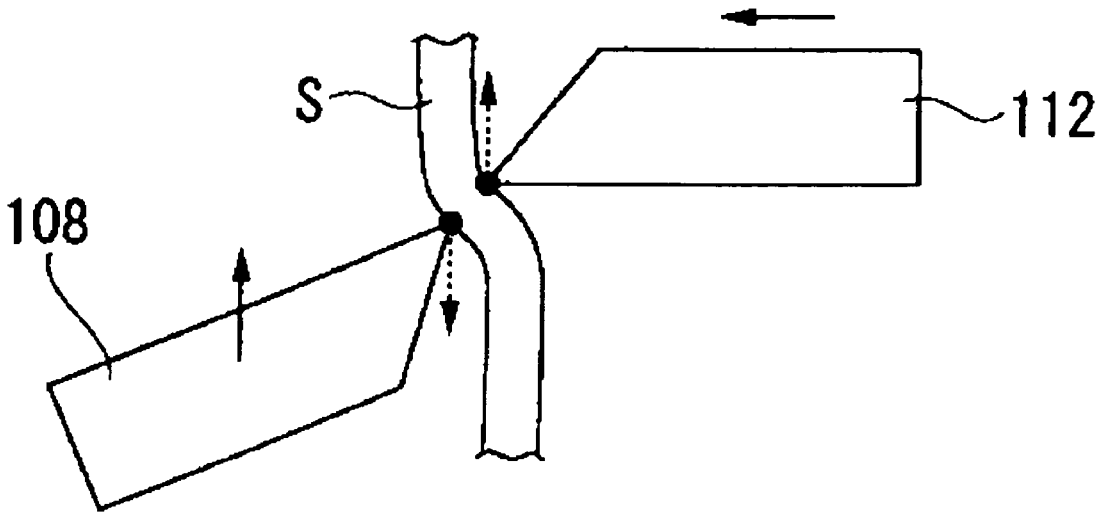
FIG. 8 PRIOR ART
FIG. 8 is an enlarged view of a main part during conventional cutting of a sheet material.

FIG. 5 illustrates a sheet material cutting unit according to a third embodiment of the present invention.

The movable blade 12 of a sheet material cutting unit 5*c* according to this embodiment is not provided with the sheet material movably holding portion provided for the first embodiment. Instead, sheet material fixedly holding portions 18*a* and 18*b* are provided with a plurality of air suction holes 22*a* and 22*b*. The holes connect with a suction pump. By sucking air through the holes just before the sheet material S is cut, the sheet material S can be retained by being sucked by the sheet material fixedly holding portions 18*a* and 18*b*. By continuing air suction to maintain the retention of the sheet material and thus preventing the sheet material S from falling when the movable blade 12 is horizontally moving with respect to the fixed blade 8 to cut the sheet material S, the cutting can be made stable.

Although, in this embodiment, the air suction holes 22 are provided for both the sheet material fixedly holding portions 18*a* and 18*b*, even if the air suction holes 22 are provided for only the sheet material fixedly holding portion 18*a* downstream from the cutting position of the sheet material S in the sheet material transfer direction, stable cutting can be secured.

It is to be noted that, although, in the sheet material cutting units described above, the cutting edge of the movable blade 12 is V-shaped, the present invention is not limited to that shape, and, for example, the present invention can be applied to a linear or slanted cutting edge of a movable blade.

What is claimed is:

1. A sheet material cutting unit comprising:

a fixed blade;

a movable blade mounted to undergo reciprocation with respect to the fixed blade between a first direction toward the fixed blade for cutting a sheet material and a second direction away from the fixed blade, the fixed blade and the movable blade being disposed opposite to each other with a sheet material transfer path therebetween;

a movable blade holder integrally connected to an upper surface of the movable blade for reciprocation therewith;

sheet material retaining means for retaining the sheet material on the sheet material transfer path during cutting of the sheet material, the sheet material retaining means comprising a fixed sheet material holding portion and a movable sheet material holding portion disposed opposite to the fixed sheet material holding portion with the sheet material transfer path therebetween, the movable sheet material holding portion being mounted on the movable blade holder for reciprocation therewith;

transmitting means for transmitting reciprocal movement of the movable blade to the movable sheet material holding portion for maintaining the sheet material in a sandwiched state between the movable sheet material holding portion and the fixed sheet material holding portion during cutting of the sheet material, and for releasing the sheet material from the sandwiched state when the movable blade undergoes reciprocal movement in the second direction, the transmitting means comprising a notch portion formed in the movable blade holder, a biasing member disposed in the notch portion, and a protrusion of the movable sheet material holding portion extending into the notch portion and contacting the biasing member so that during movement of the movable blade in the first direction toward the fixed blade, the movement of the movable blade is transmitted to the movable sheet material holding portion; and a cover member covering the movable blade, the movable blade holder, and the movable sheet material holding portion, the cover member having side wall portions on opposite sides thereof for guiding the movable blade, the movable blade holder, and the movable sheet material holding portion during reciprocation thereof.

2. A printing device comprising: a sheet material cutting unit according to claim 1; and a printing unit disposed upstream from the sheet material cutting unit for printing on the sheet material before cutting of the sheet material by the sheet material cutting unit.

3. A sheet material cutting unit according to claim 1; wherein the first movable blade holder comprises a first movable blade holder; and further comprising a second movable blade holder integrally connected to the movable blade for reciprocation movement therewith.

4. A sheet material cutting unit according to claim 3; wherein the movable sheet material holding portion comprises a first movable sheet material holding portion; and wherein the sheet material retaining means comprises a second movable sheet material holding portion mounted on the second movable blade holder for reciprocation therewith and mounted relative to the first movable sheet material holding portion so as to sandwich the movable blade therebetween.

5. A sheet material cutting unit according to claim 4; wherein the notch portion comprises a first notch portion, the biasing member comprises a first biasing member, and the protrusion comprises a first protrusion; and wherein the transmitting means further comprises a second notch portion formed in the second movable blade holder, a second biasing member disposed in the second notch portion, and a second protrusion extending into the second notch portion and contacting the second biasing member so that during movement of the movable blade in the first direction toward the fixed blade, the movement of the movable blade is transmitted to the second movable sheet material holding portion.

6. A printing device comprising: a sheet material cutting unit according to claim 5; and a printing unit disposed upstream from the sheet material cutting unit for printing on the sheet material before cutting of the sheet material by the sheet material cutting unit.

7. A sheet material cutting unit according to claim 1; wherein the movable blade holder has a plate-shaped structure.

8. A sheet material cutting unit comprising:

a stationary blade;

a movable blade mounted to undergo reciprocal movement toward and away from the stationary blade for cutting a sheet material moving along a sheet material transfer path;

a movable blade holder integrally connected to the movable blade for reciprocal movement therewith;

a sheet material retaining structure that retains the sheet material on the sheet material transfer path during cutting of the sheet material, the sheet material retaining structure having a stationary sheet material holding portion and a movable sheet material holding portion disposed opposite to the stationary sheet material holding portion with the sheet material transfer path therebetween, the movable sheet material holding portion being mounted on the movable blade holder for reciprocal movement therewith; and a transmitting structure that transmits reciprocal movement of the movable blade to the movable sheet material holding portion to maintain the sheet material in a sandwiched state between the movable sheet material holding portion and the stationary sheet material holding portion during cutting of the sheet material, the transmitting structure having a notch portion formed in the movable blade holder, a biasing member disposed in the notch portion, and a protrusion of the movable sheet material holding portion extending into the notch portion and contacting the biasing member so that during movement of the movable blade toward the stationary cutting member, the movement of the movable blade is transmitted to the movable sheet material holding portion.

9. A sheet material cutting unit according to claim 8; further comprising a cover member covering the movable blade, the movable blade holder, and the movable sheet material holding portion, the cover member having side wall portions on opposite sides thereof for guiding the movable blade, the movable blade holder, and the movable sheet material holding portion during reciprocal movement thereof.

10. A sheet material cutting unit according to claim 8; wherein the movable blade holder has a plate-shaped structure.

11. A printing device comprising: a sheet material cutting unit according to claim 8; and a printing unit disposed upstream from the sheet material cutting unit for printing on the sheet material before cutting of the sheet material by the sheet material cutting unit.

12. A sheet material cutting unit comprising:

a stationary blade;

a movable blade mounted to undergo reciprocal movement toward and away from the stationary blade for cutting a sheet material moving along a sheet material transfer path;

first and second movable blade holders integrally connected to the movable blade for reciprocal movement therewith;

a sheet material retaining structure that is connected to the first and second movable blade holders for reciprocal movement therewith and that retains the sheet material on the sheet material transfer path during cutting of the sheet material, the sheet material retaining structure having first and second stationary sheet material holding portions and first and second movable sheet material holding portions having end parts confronting the respective first and second stationary sheet material holding portions with the sheet material transfer path therebetween; and a transmitting structure that transmits reciprocal movement of the movable blade to the first and second movable sheet material holding portions to maintain the sheet material in a sandwiched state between the first and second movable sheet material holding portion and the first and second stationary sheet material holding portions during cutting of the sheet material, the transmitting structure having a pair of notch portions formed in the respective first and second movable blade holders, a pair of biasing members disposed in the respective notch portions, and a pair of protrusions of the respective first and second movable sheet material holding portions extending into the respective notch portions and contacting the respective biasing members so that during movement of the movable blade toward the stationary cutting member, the movement of the movable blade is transmitted to the first and second movable sheet material holding portions.

13. A sheet material cutting unit according to claim 12; further comprising a cover member covering the movable blade, the first and second movable blade holders, and the first and second movable sheet material holding portions, the cover member having side wall portions on opposite sides thereof for guiding the movable blade, the first and second movable blade holders, and the first and second movable sheet material holding portions during reciprocal movement thereof.

14. A sheet material cutting unit according to claim 12; wherein each of the first and second movable blade holders has a plate-shaped structure.

* * * * *